United States Patent [19]

Bevilacqua

[11] Patent Number: 5,035,095

[45] Date of Patent: Jul. 30, 1991

[54] BASEMENT WALL STRUCTURE TO PREVENT WATER LEAKAGE

[76] Inventor: Joseph Bevilacqua, 1341 Copley Rd., Akron, Ohio 44320

[21] Appl. No.: 451,296

[22] Filed: Dec. 15, 1989

[51] Int. Cl.[5] ..... E02O 19/12

[52] U.S. Cl. ..... 52/169.5

[58] Field of Search ..... 52/169.5, 305; 405/38, 405/43

[56] References Cited

U.S. PATENT DOCUMENTS

| | | | |
|---|---|---|---|
| 3,654,765 | 4/1972 | Healy et al. | 52/169.5 |
| 3,888,087 | 6/1975 | Bergsland | 52/169.5 |
| 4,045,964 | 9/1977 | Barclay | 52/169.5 |
| 4,574,541 | 3/1986 | Raidt et al. | 52/169.5 |
| 4,704,048 | 11/1987 | Ahlgrimm | 52/169.5 |

FOREIGN PATENT DOCUMENTS

| | | | |
|---|---|---|---|
| 107188 | 9/1965 | Norway | 52/169.5 |

*Primary Examiner*—Michael Safavi

*Attorney, Agent, or Firm*—Oldham & Oldham Co.

[57] ABSTRACT

A system for forming a water tight spaced cavity adjacent a basement wall sitting on a footer adjacent the footer drain to prevent water leakage into the basement which incorporates a light weight material with suitable strength to form a water tight sealed open spaced cavity adjacent the wall and the footer drain extending from the footer to near the surface of the ground adjacent the wall so as to keep the outer surface of the wall dry. Preferably a polystyrene or a light weight material is utilized with ribbed or other internal structural supports made to support the outer skin of the unit away from the wall to create the open spaced cavity adjacent the wall.

5 Claims, 3 Drawing Sheets

FIG-2
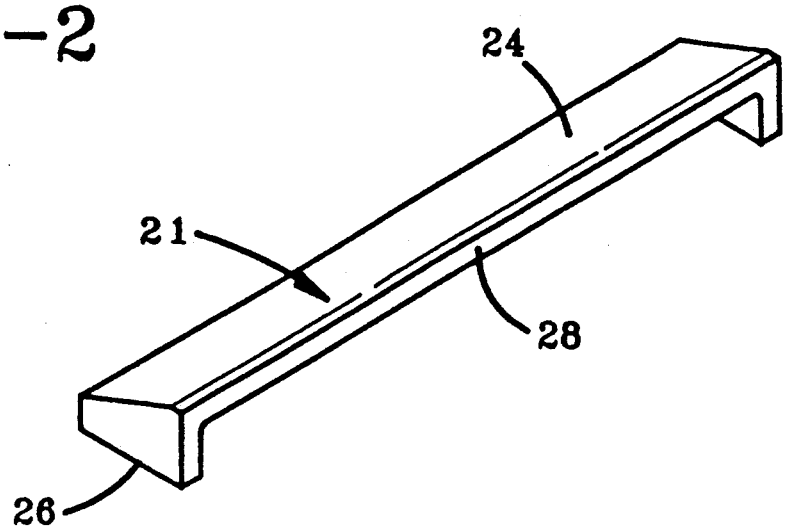
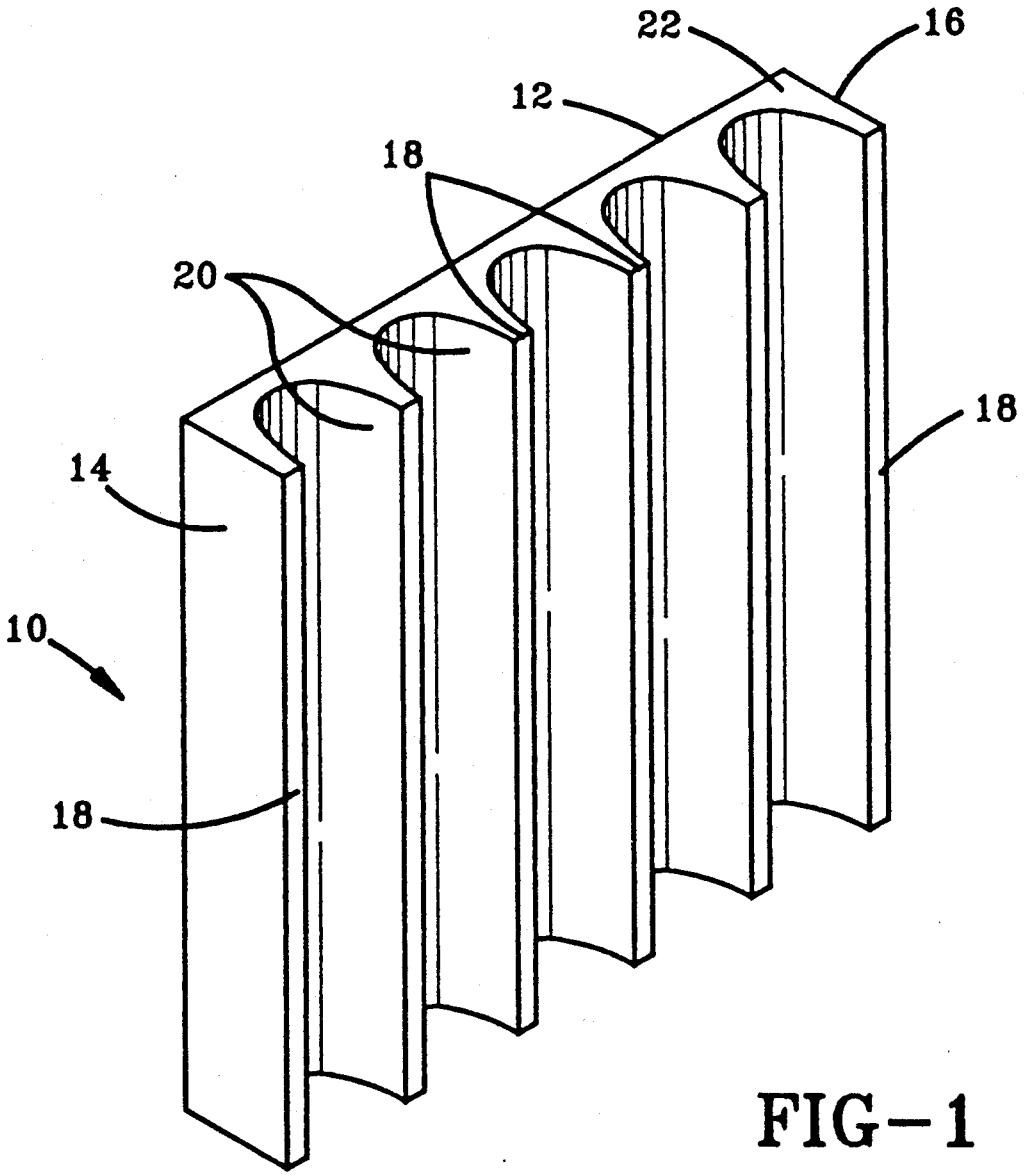
FIG-1

FIG-3
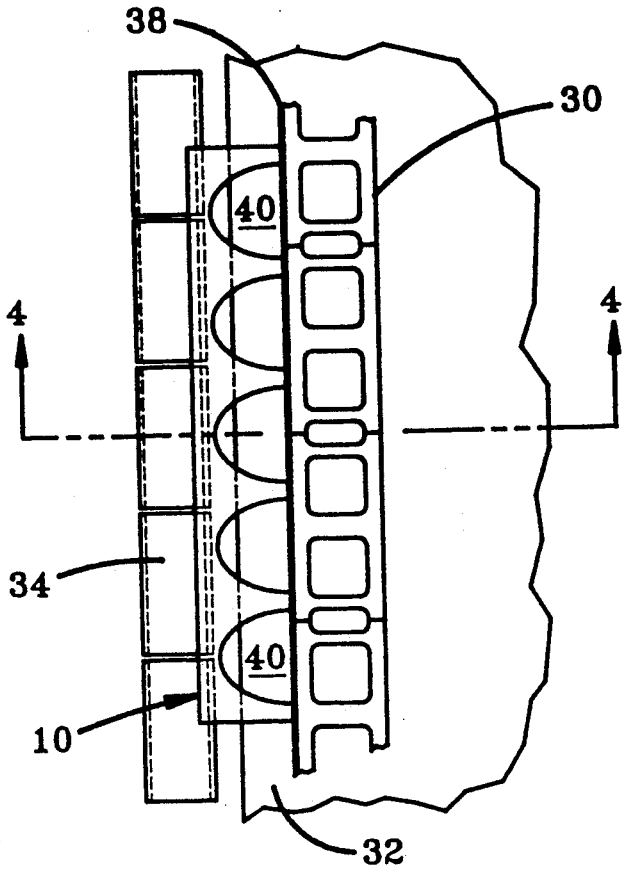
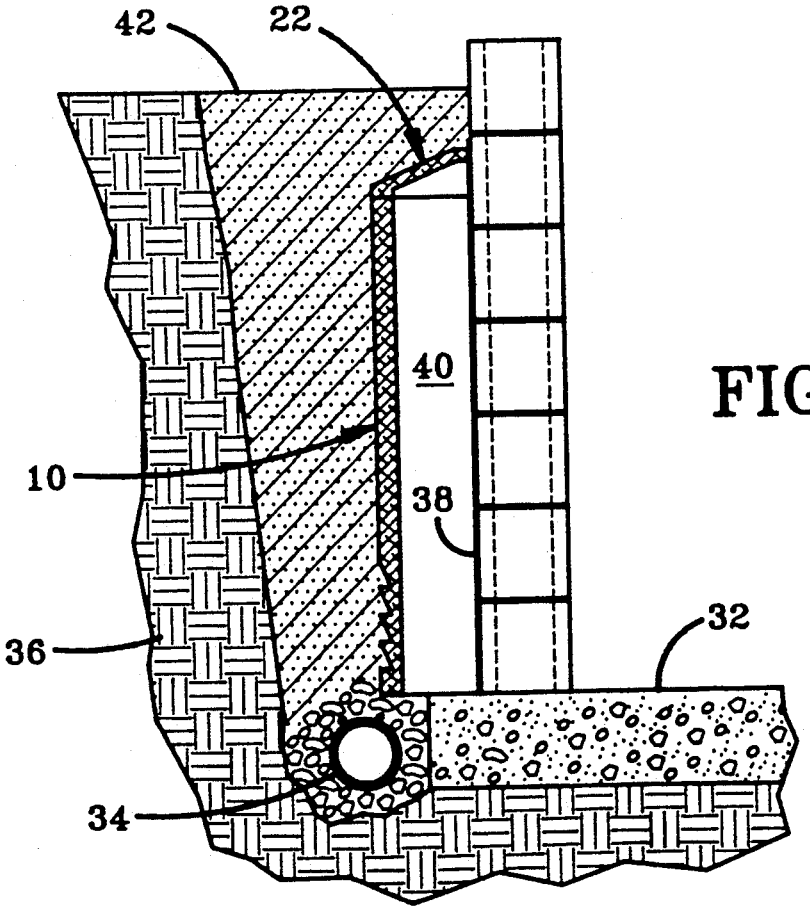
FIG-4

BASEMENT WALL STRUCTURE TO PREVENT WATER LEAKAGE

BACKGROUND OF THE INVENTION

It has long been known that water leakage into basements is a significant and continuous problem. Most basements are currently built from concrete or cinder block construction, and if water lays against the basement wall from the outside, seeping in through the ground, there will frequently be leakage of water through the wall and into the basement.

Many attempts have been made to solve that problem, and there are many different types of building codes and requirements necessary to try to solve the problem. For example, most walls are built on a concrete footer with the footer extending for at least a few inches laterally from the concrete wall itself, and most building codes require that there be a footer water drain which lays immediately adjacent the footer normally in a gravel bed and where the drain tile is a multiple perforated plastic tubing of about six to eight inches diameter, and with the gravel extending up over the top of the drain tile. What happens frequently that mud or silt seeping from the soil that then is placed over the gravel will tend to clog the gravel and/or get down and clog the drain tile itself so that it does not function properly. Once the drain tile is not functioning properly, water tends to back up and lay against the basement wall leading to water leakage into the basement.

The building codes also all usually require some type of sealant to be placed on the wall itself, such as tar or a parging material, with this sealant extending slightly above ground level and clear down to the footer.

Various other techniques have been incorporated to prevent water leakage into the basement wall to deal with the leakage itself after it occurs. These are represented by my own previous U.S. Pat. Nos. 4,590,722 and 4,612,742. These techniques, however, deal really with solving the problem of the water once it gets into the basement. Hence, this instant invention deals with trying to prevent the water from getting into the basement in the first place.

SUMMARY OF THE INVENTION

Briefly, the invention comprises a system performing a water tight spaced cavity adjacent a basement wall sitting on a footer adjacent to a footer drain to prevent water leakage into the basement.

The system is designed to be low in cost, easily installed, and light in weight so that it is easy to handle, but having sufficient structural strength to withstand the force of the dirt that is filled back in once the basement wall has been built, and the wall sealed to meet the building code requirements.

It is believed that a foamed polystyrene material such as that sold by Dow Chemical Company under the trademark STYROFOAM material will meet these requirements when designed with structural capabilities in the design, or perhaps a polystyrene reinforcement material of some type. It should be understood, however, that the material must be water resistant since it is going to be in the harsh, wet environment of the ground surrounding it.

Preferably the unit should be easy to install, probably in four foot by eight foot sizes and having about a six to eight inch thickness, so they can be easily laid into position, adhesively secured, and done most expeditiously and inexpensively.

The invention particularly contemplates a system for forming a water tight spaced cavity adjacent the basement the wall sitting on a footer adjacent a footer drain to prevent water leakage into the basement which comprises a unit attached to the outside of the basement wall from the footer to just below the surface ground level, such unit having an open relationship to the wall and to the footer drain, but a sealed outer skin to the ground outside the unit, the unit being in a water tight sealed relationship to the wall to create a water tight open spaced cavity adjacent the wall and the footer drain.

DESCRIPTION OF THE DRAWINGS

FIG. 1 is a three dimensional perspective view of the unit of the invention;

FIG. 2 is a perspective three dimensional view of the top cap which fits of the top of the basic unit of FIG. 1;

FIG. 3 is a top broken away view showing the unit in relationship to a basement wall and the footer drain;

FIG. 4 is an end elevational view of the wall of FIG. 3 taken on line 4—4 partially broken away;

DETAILED DESCRIPTION OF THE INVENTION

Figure 5:
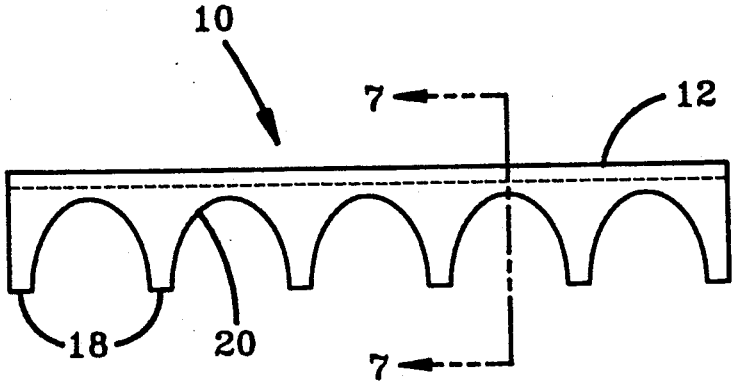
FIG. 5 is a top plan view of the unit itself.

The basic unit comprising the invention is shown in the perspective combined diagrams of FIGS. 1 and 2, and is generally depicted by the numeral 10. It encompasses a flat outer surface 12 with closed ends 14 and 16, and a plurality of extending ribs 18 which define generally U-shaped sections 20, such ribs 18 extending away from the face 12. A portion of the unit 10 extending from outer surface 12 to the ribs 18 effectively forms a sealed outer skin to the ground.

It should be understood that the unit 10 can be either molded or extruded from a light weight material such as a polystyrene foam, or that it might be reinforced appropriately, but in any event, it is simple and inexpensive to make and is relatively light weight, particularly with all of the channels 20 and the reinforcing ribs 18 forming a good structural base to support the face 12 away from the basement wall as will be more fully defined hereinafter.

FIG. 2 illustrates the cap indicated generally by numeral 21 which comprises a sloped top surface 24 and bottom edges 26 that will fit on top of the upper surface 22 of unit 10, and be adhesively secured thereto in a water tight fit. The back surface 28 likewise coincides with the ends of the respective ribs 18 at the ends of unit 10, and combine an overall extension that when adhesively secured to the wall of the basement forms a water tight closure therewith.

Turning now to the cross sectional top view configuration of FIG. 3, the numeral 30 indicates a conventional cinder block or concrete block wall that is built on to a footer 32, and includes the conventional drain tile 34 that is surrounded by soil 36 in a conventional manner. The block wall 30 also has an outside sealing layer 38 normally associated therewith which may be tar, or some other water sealant coating that is required by normal building codes. In other words, the block wall 30 is built in exactly the conventional manner to that normally defined for basement construction by most building codes.

The unit 10 of the invention is designed to sit on the footer 32 in the manner indicated and be adhesively and in a water tight seal attached at the ends of the rib 18 and at the top of the cap 21 to the wall 30, as well as to the outer sealant coat 38 on wall 30. Any suitable adhesive attachment that would achieve the sealing is contemplated to suffice, and, in fact, the unit could even be placed in position with the tar layer 38 still wet so that it would be pressed into and actually sealed right into the tar layer 38. It should be noted that the cap 21 is not shown in position in FIG. 3 so that the open half or the open spaced cavity indicated generally by numeral 40 is defined by the unit 10 adjacent to the wall 30. This, of course, also shows how the cavity 40 opens into the soil 36 surrounding the footer drain 34. Hence, even though the unit 10 and cap 21 are designed to be attached to the wall 30 so as to have a water tight connection, in case any water does enter into the cavity 40, it will drain down into the soil 36 and into the drain tile 34.

Once the unit 10 and cap 21 are in position and adhesively secured to the wall 38, and with the bottom ends of the ribs 18 also secured to the footer 32 by the same type of adhesive water sealing relationship, the excavated dirt removed to allow construction of the wall 30, can then be filled back in to the level indicated by numeral 42, and the structure of the unit 10 and cap 21 is such as to withstand the lateral forces that are created by filling the dirt back in.

It can be seen that this creates an open spaced cavity adjacent the wall and the footer drain. This, of course, keeps the outside surface 38 of the wall 30 dry, and, hence prevents water seepage through the wall into the basement.

Figure 6:
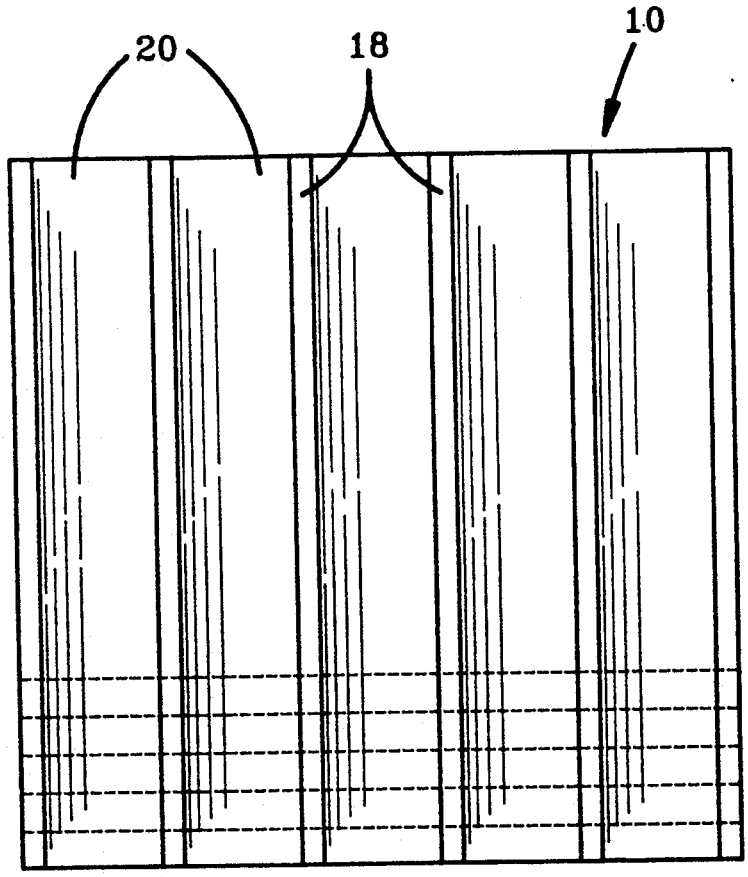
FIG. 6 is a side elevational view of the unit itself.
Figure 7:
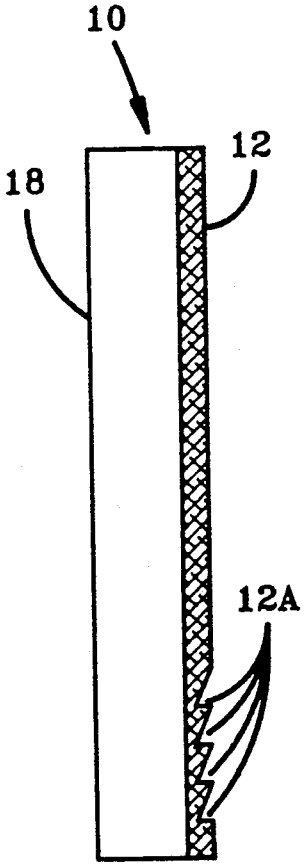
FIG. 7 is a cross sectional view of the unit itself taken on line 7—7 of FIG. 5.

FIGS. 5, 6 and 7 are merely showing the unit 10 in its full structural detail, and particularly show the light weight configuration which is desired to facilitate moving and positioning the unit along the wall and on the footer as the basement is being built, and it is contemplated that one man could easily handle this unit because of its light weight. While an arch shaped configuration is shown in FIG. 5 to form the channels 20 and ribs 18, other constructions could be utilized that would still give a strengthening support to the outer surface 12 with the inner rib projections resting on the outside wall of the basement.

It should also be understood that any suitable material could be utilized for unit 10 and cap 21, and that STYROFOAM is suggested only because of its light weight, but still having significant structural strength particularly when designed as indicated hereinabove, but that other strengthening means could be utilized in the STYROFOAM, or the unit could be actually reinforced with fiberglass just as an outside skin, for example. The whole idea, however, is to provide the open spaced cavity adjacent the wall which is water tight to the surrounding dirt that fills in that area outside the wall when the basement wall is completed and the footer drains are appropriately in place.

FIG. 7 also shows that the bottom end of the outer surface 12 can be formed with indentations **12*a*** which will be filled with dirt when the unit is installed so as to be locked into place and to eliminate any tendency to slide upwardly by water pressure or the like.

While in accordance with the patent statutes, only the best known embodiment of the invention has been illustrated and described in detail, it is to be particularly understood that the invention is not limited thereto or thereby, but that the inventive scope is defined in the appended claims.

What is claimed is:

1. A system for forming a water tight hollow cavity adjacent to an at least partially subterranean wall of a basement of a building, said cavity sitting atop a footer drain preventing water leakage into the basement, said system comprising:

a unit attached to the outside of the basement wall from the footer to just below the surface ground level, said unit having an opening relationship to the footer drain, but a sealed outer skin to the ground outside the unit, and a water tight sealed relationship to the wall to create a water tight open hollow cavity adjacent the wall and the footer drain;

said unit further having vertically extending structural ridges formed from the sealed outer skin to rest on the wall and support the outer skin; and said unit having a closed cap on the outer edge sloped downwardly away from the wall to direct water downwardly and in a water tight sealed relation to the wall and the upper edge of the unit.

2. A system according to claim 1 where the unit is made from a light weight material with suitable strength to withstand the force of the soil and not deteriorate from the constantly wet environment of the soil.

3. A system according to claim 1 where the unit is arranged to allow any water which may get into the hollow cavity to freely drain to the footer drain.

4. A system according to claim 3 where at least a portion of the outer skin is formed with indentations to allow the surrounding soil to lock the system in place.

5. A system according to claim 1 where the unit is formed with a light polystyrene material.

* * * * *